US009693394B2

(12) United States Patent
Sweeney et al.

(10) Patent No.: US 9,693,394 B2
(45) Date of Patent: Jun. 27, 2017

(54) ELECTRICAL HEATING DEVICE

(71) Applicant: BorgWarner Ludwigsburg GmbH, Ludwigsburg (DE)

(72) Inventors: Stephen Sweeney, Ballinorig (IE); Anthony Maher, Foynes (IE); Katherine O'Sullivan, Co. Kerry (IE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 15/149,584

(22) Filed: May 9, 2016

(65) Prior Publication Data

US 2016/0332507 A1 Nov. 17, 2016

(30) Foreign Application Priority Data

May 11, 2015 (DE) ..... 10 2015 107 316

(51) Int. Cl.

| | |
|---|---|
| ***H05B 1/02*** | (2006.01) |
| ***H05B 3/50*** | (2006.01) |
| ***F24H 9/18*** | (2006.01) |
| ***F24H 3/04*** | (2006.01) |
| ***H05B 3/14*** | (2006.01) |

(52) U.S. Cl.

CPC ..... *H05B 3/50* (2013.01); *F24H 3/0405* (2013.01); *F24H 9/1872* (2013.01); *H05B 3/141* (2013.01); *H05B 2203/019* (2013.01); *H05B 2203/02* (2013.01); *H05B 2203/023* (2013.01)

(58) Field of Classification Search

CPC .. H05B 1/0236; H05B 3/50; H05B 2203/019; H05B 2203/02; F24H 9/1872

USPC ..... 219/202, 497, 504, 505

See application file for complete search history.

(56) References Cited

U.S. PATENT DOCUMENTS

| | | | | |
|---|---|---|---|---|
| 4,818,842 | A * | 4/1989 | Walty | F02M 31/125 123/549 |
| 5,432,323 | A * | 7/1995 | Sopory | H05B 3/146 219/548 |
| 8,965,187 | B2 * | 2/2015 | Borgmeier | F16L 53/008 219/484 |
| 2003/0206730 | A1 * | 11/2003 | Golan | A47J 27/16 392/399 |
| 2006/0263073 | A1 * | 11/2006 | Clarke | H05B 1/0275 392/347 |
| 2008/0135536 | A1 | 6/2008 | Kochems et al. | |
| 2011/0297665 | A1 * | 12/2011 | Parker | H05B 3/22 219/494 |
| 2012/0061366 | A1 * | 3/2012 | Kohl | F24H 3/0429 219/202 |

FOREIGN PATENT DOCUMENTS

DE 10 2006 055 872 B3 3/2008

* cited by examiner

*Primary Examiner* — Mark Paschall

(74) *Attorney, Agent, or Firm* — Bose McKinney & Evans LLP

(57) ABSTRACT

Disclosed is an electrical heating device for heating the interior of a vehicle, comprising a plurality of PTC heating rods each comprising ceramic PTC heating resistors, heat sinks for transferring heat from the PTC heating rods to an air flow, and a holder holding the PTC heating rods. The PTC heating rods are connected in series to an NTC heating rod comprising at least one NTC resistor, wherein the NTC heating rod is held by the holder.

10 Claims, 3 Drawing Sheets

ELECTRICAL HEATING DEVICE

RELATED APPLICATIONS

This application claims priority to DE 10 2015 107 316.1, filed May 11, 2015, which is hereby incorporated herein by reference in its entirety.

BACKGROUND

The present invention relates to an electrical heating device for heating the interior of a vehicle. Such heating devices heat air that is blown into a vehicle cabin, an example of which is disclosed in DE 10 2006 055 872 B3.

Electrical heating devices of this kind need sophisticated control electronics for controlling heating power and current. This is especially the case when the heating device is operated at high voltages of several hundred volts.

SUMMARY

This disclosure teaches how the control and monitoring needs of a heating device of a vehicle can be reduced.

A heating device according to this disclosure combines PTC (Positive Temperature Coefficient) and NTC (Negative Temperature Coefficient) resistors. While the electrical resistance of PTC resistors increases with temperature, the electrical resistance of NTC resistors decreases with temperature. By connecting an NTC resistor in series with one or more PTC resistors, inrush currents can be limited. Thus, monitoring and control of electric current can be simplified.

A combination of PTC and NTC resistors can be achieved by adding an NTC resistor to every PTC resistor of a heating rod. For example, an NTC resistor and PTC resistor can be stacked on top of each other. Inside a heating rod one or more of such stacks can be electrically contacted by a contact plate made of sheet metal.

In one embodiment, a combination of PTC and NTC resistors is achieved by providing PTC heating rods containing one or more PTC heating resistors, but no NTC resistor, and an NTC heating rod containing at least one NTC heating resistor, but no PTC heating resistor. The PTC heating rods are connected electrically in series to the NTC heating rod. A single NTC heating rod is sufficient to provide inrush current protection for all PTC heating rods, especially if the PTC heating rods are connected in parallel to each other. It also possible to use several NTC heating rods which are each connected in series to one more PTC heating rods. Each NTC heating rod is then used for one heater battery of the heating device. By applying a voltage to only a single heater battery or several heater batteries the heating power can be adjusted.

A heating device comprising PTC and NTC heating rods can be manufactured economically as the heating rods need to differ only in the resistors contained therein. Thus, the same parts can be used for assembling the heating rods, e.g., contact plates for electrically contacting the resistors, positioning frames for positioning the resistors relative to contact plate, housings and insulation parts.

The NTC resistors can be semiconductors or ceramic heating resistors, for example based on oxides of Mn, Ni, Fe, Cu and/or Ti. The PTC resistors may be based on barium titanate or other ferroelectric ceramics.

An advantageous refinement of this disclosure is that each of the heating rods comprises a tube in which the ceramic PTC or NTC resistors, respectively, are arranged. The resistors are then protected from unwanted contact and dirt by the tube housing. Preferably two contact plates are arranged inside each tube. The PTC or NTC resistors, respectively, are then arranged between these two contact plates and thereby electrically contacted. The contact plates can both be electrically insulated from the surrounding housing, e.g., the tube. For low voltage applications, e.g., operating voltages of up to 25 V, it is possible to use only a single contact plate for each heating rod. Then the resistors contact on one side the contact plate and on an opposite side the housing, e.g., the tube, which is grounded.

The heat sinks connected to the heating rods may all be identical. It is also possible to use different heat sinks, e.g., heat sinks of different shape or size, with different heat transfer characteristics. Thus the NTC heating rod or NTC heating rods can be connected to heat sinks that have a heat transfer characteristic that matches the heat production characteristic of the NTC heating rod or NTC heating rods which is usually different from the heat production characteristic of the PTC heating rods. Thereby a more equal temperature distribution can be achieved over the whole flow cross-section of the heating device. For example, the distance between a PTC heating rod and an NTC heating rod may be different from the distance between PTC heating rods, e.g., 10% different or more.

An advantageous refinement of this disclosure is that the heat sinks adjacent to the NTC heating rod have a different heat transfer characteristic than the heat sinks that are adjacent only to one or two PTC heating rods. For example, the surface area of the heat sinks adjacent to the NTC heating rod may be at least 20% different from the heat sinks that are adjacent only to one or two PTC heating rods. If a heat sink is adjacent to both a PTC heating rod and an NPC heating rod, its width has to be divided by two before it is compared to a heat sink arranged at an edge of the heating device so that it is adjacent only to one heating rod.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
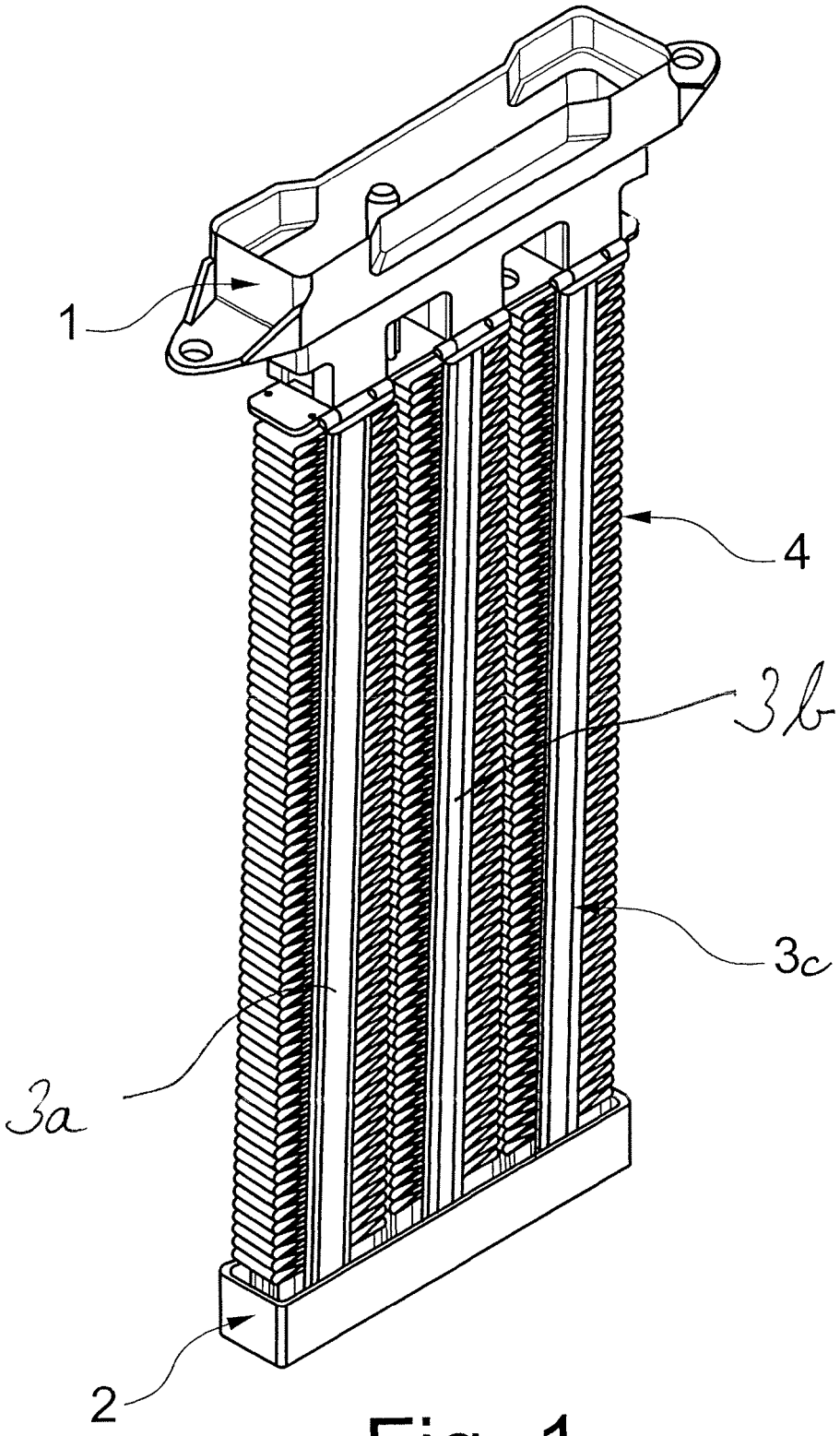
FIG. 1 shows an embodiment of an electrical heating device.

The heating device shown in FIG. 1 comprises a plurality of heating rods 3*a*, 3*b*, 3*c* and heat sinks 4 attached to the heating rods. The number of heating rods may vary. The heat sinks 4 transfer heat from the heating rods to an air flow. The heat sinks 4 may be separate parts that are connected to the heating rods or the heat sinks 4 may be integral parts of the heating rods. A front end of the heating rods 3 is stuck in a holder 1, a rear end in a holder 2. It is also possible to use a holder that is a rectangular frame surrounding the heating rods. The holder 1 can form a plug connector for connecting the heating device to a power source, e.g., the on-board power supply of a vehicle.

Some of heating rods are PTC heating rods 3*a*, 3*c* containing ceramic PTC heating elements. One of the heating rods is an NTC heating rod 3*b* containing ceramic NTC heating elements. In the embodiment shown, the heating rod 3*b* in the middle is an NTC heating rod and the two heating rods 3*a*, 3*c* next to it are PTC heating rods. The NTC heating rod 3*b* is connected in series to the PTC heating rods 3*a*, 3*c*. The PTC heating rods 3*a*, 3*c* are connected in parallel to each other.

Figure 2:
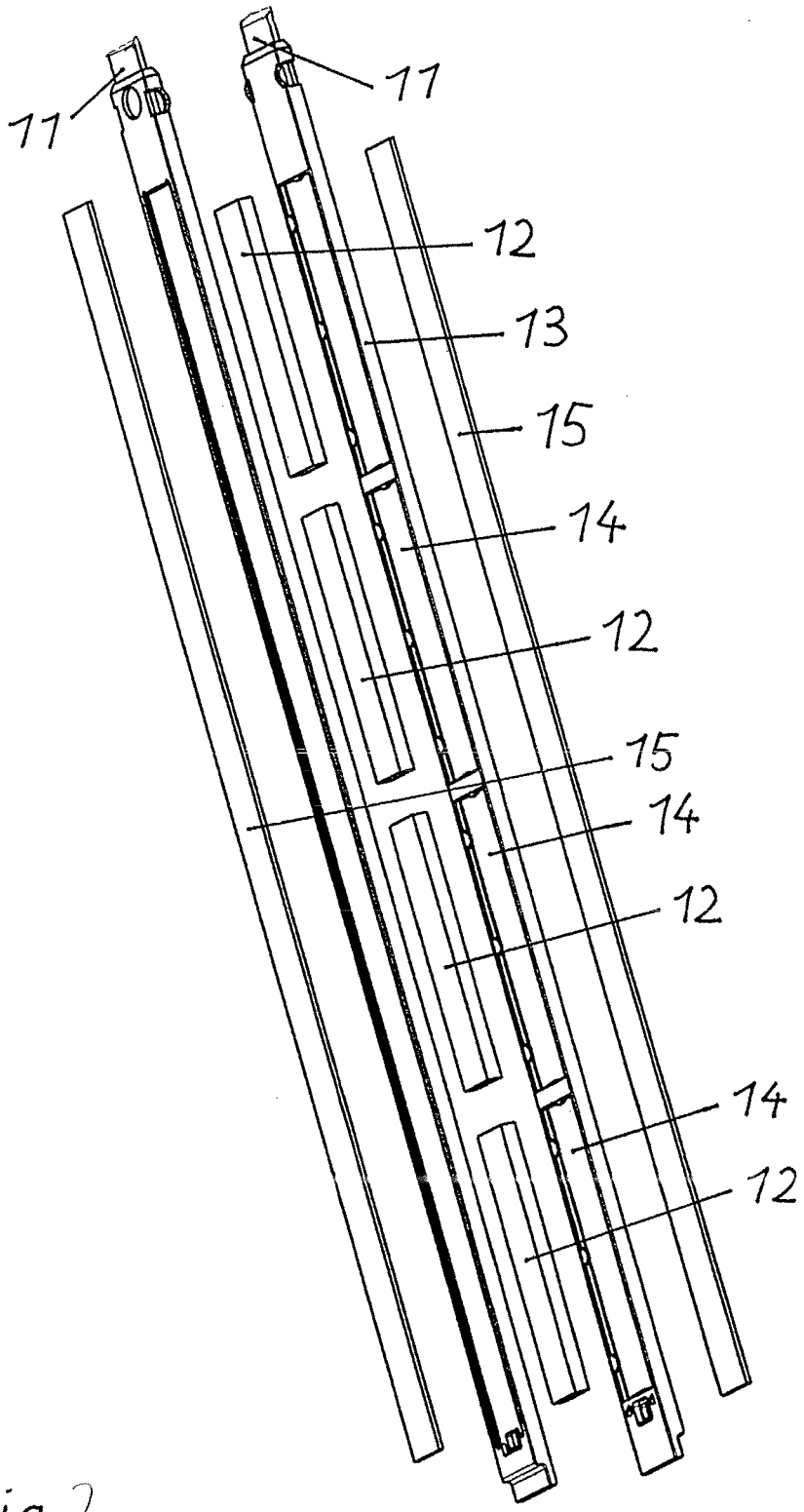
FIG. 2 shows the components of a heating rod without housing.

The heating rods 3*a*, 3*b*, 3*c* comprise a housing, which may for example be a tube. FIG. 2 shows the components of a heating rod 3*a*, 3*b*, 3*c* without the housing. Each heating rod 3*a*, 3*b*, 3*c* contains ceramic resistors 12. If the heating rod is a PTC heating rod, the ceramic resistors 12 are ceramic PTC resistors. If the heating rod is an NTC heating rod, the ceramic resistors 12 are ceramic NTC resistors. The ceramic resistors 12 are arranged between two contact plates 11 which electrically contact the ceramic resistors 12. The contact plates 11 are electrically insulated from the housing, e.g., by strips of insulating material 15, for example insulating ceramic like alumina.

One contact plate 11 or both contact plates 11 may carry a positioning frame 13 for positioning the resistors 12. The positioning frames 13 may define compartments 14 for the resistors 12. The resistors 12 may be held by the positioning frames 13 by means of clamping protrusions, e.g., noses.

Instead of using two positioning frames 13 in each heating rod 3*a*, 3*b*, 3*b*, it is also possible to use only a single positioning frame. For example, a positioning frame may be used which carries two contact plates 11.

As the NTC heating rod 3*b* and the PTC heating rods 3*a*, 3*c* will usually have different heating characteristics and produce different amounts of heat, it can be advantageous to use heat sinks 4 with different heat transfer characteristics. For example the shape, size, or width of heat sinks 4 connected to the NTC heating rods 3*b* may be different from the shape, size, or width of heat sinks 4 connected to the PTC heating rods 3*a*, 3*c*. Thereby temperature differences between the various heat sinks 4 can be minimized.

Figure 3:
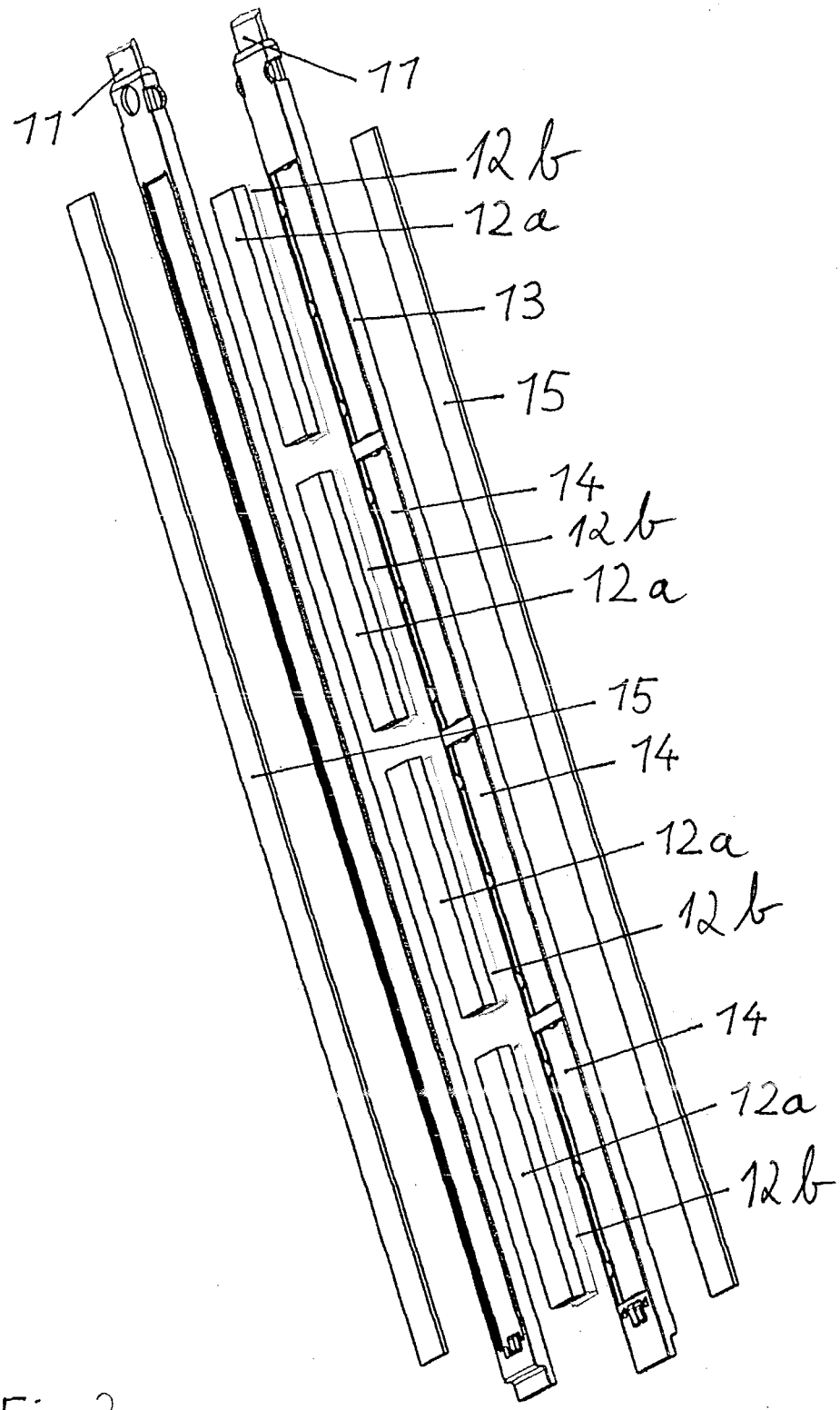
FIG. 3 shows the components of a heating rod without housing of a different embodiment of an electrical heating device.

FIG. 3 shows a different embodiment of a heating rod that can be used in a heating device as shown in FIG. 1. The heating rod shown in FIG. 3 without its housing comprises both PTC resistors 12*a* and NTC resistors 12*b* stacked on top of each other. Thus each PTC resistor 12*a* is connected in series to an NTC resistor 12*b*. The heating rod comprising PTC resistors 12*a* and NTC resistors 12*b* can otherwise be like the PTC or NTC heating rods described above.

It is possible that all heating rods of an electrical heating device may be such heating rods that comprise both NTC and PTC resistors. It is also possible to connect such an NTC-PTC heating rod in series to a PTC heating rod. Then the NTC-PTC heating rod can be used to replace a NTC heating rod 3*b* in the electrical heating device described with reference to FIGS. 1 and 2.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SIGNS

1 holder
2 holder
3*a* PTC heating rod
3*b* NTC heating rod
3*c* PTC heating rod
4 heat sink
11 contact plate
12 resistor
12*a* PTC resistor
12*b* NTC resistor
13 positioning frame
14 compartment
15 electrical insulation

What is claimed is:

1. An electrical heating device for heating the interior of a vehicle, comprising:
- a plurality of PTC heating rods each comprising ceramic PTC heating resistors;
- an NTC heating rod comprising at least one NTC resistor;
- a holder that holds the PTC heating rods and the NTC heating rod; and
- heat sinks for transferring heat from the PTC heating rods to an air flow;
- wherein the PTC heating rods are connected in series to the NTC heating rod; and
- wherein the PTC heating rods are connected in parallel to each other.

2. The electrical heating device according to claim 1, wherein the PTC heating rods comprise tubes in which the PTC resistors are arranged and the NTC heating rod comprises a tube in which the at least one NTC resistor is arranged.

3. The electrical heating device according to claim 1, wherein the at least one NTC heating resistor is a ceramic NTC resistor.

4. The electrical heating device according to claim 1, wherein the NTC heating rod is arranged between PTC heating rods.

5. The electrical heating device according to claim 1, wherein the holder comprises a plug in connector for connecting the electrical heating device to a power source.

6. The electrical heating device according to claim 1, wherein each PTC heating rod and each NTC heating rod comprises a frame for positioning the resistors.

7. The electrical heating device according to claim 1, wherein each PTC heating rod and each NTC heating rod comprises two contact plates between which the respective PTC and NTC resistors are arranged, wherein the two contact plates are electrically insulated from a housing of the respective heating rod.

8. The electrical heating device according to claim 1, wherein the heat sinks adjacent to the NTC heating rod have a different heat transfer characteristic than the heat sinks that are adjacent only to one or two PTC heating rods.

9. An electrical heating device for heating the interior of a vehicle, comprising:
- a plurality of PTC heating rods each comprising ceramic PTC heating resistors;
- an NTC heating rod comprising at least one NTC resistor;
- a holder that holds the PTC heating rods and the NTC heating rod; and
- heat sinks for transferring heat from the PTC heating rods to an air flow;
- wherein the PTC heating rods are connected in series to the NTC heating rod;

wherein the PTC heating rods comprise tubes in which the PTC resistors are arranged and the NTC heating rod comprises a tube in which the at least one NTC resistor is arranged; and wherein each PTC heating rod and each NTC heating rod comprises a frame for positioning the resistors.

10. The electrical heating device according to claim 9, wherein the PTC heating rods are connected in parallel to each other.

* * * * *